US012258777B2

(12) United States Patent
Chester

(10) Patent No.: US 12,258,777 B2
(45) Date of Patent: Mar. 25, 2025

(54) POST PULLER

(71) Applicant: Chester Brown Industries Pty Ltd, Port Kennedy (AU)

(72) Inventor: Peter Chester, Wannanup (AU)

(73) Assignee: Chester Brown Industries Pty Ltd, Port Kennedy (AU)

( * ) Notice: Subject to any disclaimer, the term of this patent is extended or adjusted under 35 U.S.C. 154(b) by 0 days.

(21) Appl. No.: 17/768,833

(22) PCT Filed: Oct. 7, 2020

(86) PCT No.: PCT/AU2020/051075

§ 371 (c)(1),
(2) Date: Apr. 13, 2022

(87) PCT Pub. No.: WO2021/072482

PCT Pub. Date: Apr. 22, 2021

(65) Prior Publication Data

US 2024/0102310 A1 Mar. 28, 2024

(30) Foreign Application Priority Data

Oct. 14, 2019 (AU) ..... 2019264574
Oct. 1, 2020 (AU) ..... 2020244540

(51) Int. Cl.
*E04H 17/26* (2006.01)

(52) U.S. Cl.
CPC ..... *E04H 17/265* (2013.01)

(58) Field of Classification Search
CPC .. B66C 1/586; B66C 1/59; B66C 1/34; B66C 1/00; A61G 7/10; E04H 17/265
See application file for complete search history.

(56) References Cited

U.S. PATENT DOCUMENTS 1,385,326 A 7/1921 Leisure
3,352,589 A * 11/1967 Kilboy ..... B65G 7/12 294/119

(Continued)

FOREIGN PATENT DOCUMENTS

AU 2018101158 A4 9/2018
DE 4127058 C1 8/1992

OTHER PUBLICATIONS

Internation Search Report (ISR) which issued on PCT/AU2020/051075.

*Primary Examiner* — Lee D Wilson
(74) *Attorney, Agent, or Firm* — Bauer and Joseph

(57) ABSTRACT

There is disclosed herein a post puller (10) for removing a fence post from the ground. The post puller (10) includes a scissor linkage (12) having a coupling end (14) and a post end (16) wherein the scissor linkage (12) is moveable between a first position and a second position. The post puller (10) further includes a coupling assembly (18) located at the coupling end (14) of the scissor linkage (12). The coupling assembly (18) is operatively adapted to connect the scissor linkage (12) to a pulling mechanism. The post puller (10) further includes a post gripping assembly (26) located at the post end (14) of the scissor linkage (12). The post gripping assembly (26) includes a first gripping jaw and a second gripping jaw (28, 30). The first and second gripping jaws (28, 30) are movable between an open position and a closed position as the scissor linkage (12) is moved between the first and second position. The first and second gripping jaws (28,30) are adapted to form a picket receiving opening (32) shaped to receive a star picket when the first and second gripping jaws (28, 30) are located in the closed position.

6 Claims, 3 Drawing Sheets

(56) References Cited

U.S. PATENT DOCUMENTS

| | | | | |
|---|---|---|---|---|
| D598,174 | S * | 8/2009 | Lindberg | D34/33 |
| 8,201,808 | B1 * | 6/2012 | Busalacchi | B25C 11/00 254/132 |
| 2003/0178865 | A1 * | 9/2003 | Parker | B66C 1/36 294/110.1 |
| 2006/0202497 | A1 * | 9/2006 | Cveykus | B66C 1/442 294/118 |
| 2016/0230414 | A1 * | 8/2016 | Lawrence | E04H 17/265 |
| 2018/0223562 | A1 | 8/2018 | Rosario | |

* cited by examiner

POST PULLER

CROSS REFERENCE TO RELATED APPLICATIONS

The present application is a U.S. national stage application of PCT International Application No. PCT/AU2020/051075, filed Oct. 7, 2020, and published as PCT Publication WO/2021/072482 on Apr. 22, 2021, which claims priority to Australian Application Nos. AU 2019264574, filed on Oct. 14, 2019, and AU 2020244540, filed on Oct. 1, 2020. The disclosures of all the foregoing applications are hereby incorporated by reference in their entirety into the present application.

FIELD

The invention concerns a post puller. In particular, but not exclusively, the invention concerns a post puller for use in removing a star picket type fence post from the ground.

BACKGROUND

Several devices are supported by one or more posts driven into the ground. Such devices include agricultural fences. An agricultural fence is a structure that encloses a parcel of land and is usually constructed from posts that are connected by lengths of wire. Agricultural fences play a key role in maintaining livestock. Not only do agricultural fences serve to prevent livestock from straying, they also serve to protect livestock against predators.

A typical fence post comprises an elongate post body driven into the ground in order to carry load. One type of post commonly employed in constructing fences on farms is a so-called star picket. A star picket is generally produced from metal. Being produced from metal, a star picket has several benefits over timber posts. Those benefits include that star pickets are not prone to splinter, rot or to be eaten by termites. Star pickets further are generally cost effective as they tend to be long lasting and are quick and easy to install. A fence installer is simply required to hammer a star picket into the ground at a desired location without the need of complex or expensive equipment.

From time to time it may become necessary to remove or relocate a fence. It then becomes necessary to remove or pull the fence posts from the ground. Removing fence posts can be a labour and time intensive exercise. One type of post remover employed specifically for removing a star picket comprises a plate having a star shape cut into it. The plate is required to be lifted at one end in order to remove the picket from the ground. Should the picket be located in hard ground, the plate may bend the picket during a removal operation. Employing the plate remover also requires that wire be removed from the picket to provide a sufficiently large surface area for the plate to grip the picket. Despite removing wire from a star picket, plate-type removers remain prone to slipping.

Another mechanism employed to remove star pickets include employing a chain with a half hitch placed around the picket to be removed. This mechanism is generally not effective as it is very prone to slipping.

OBJECT

It is an object of the present invention to address the problems associated with the above described mechanisms employed to remove a star picket from the ground, or at least to provide an alternative post puller for removing a star picket from the ground.

SUMMARY

According to a first aspect of the present invention there is disclosed herein a post puller including:

- a scissor linkage having a coupling end and a post end, the scissor linkage being moveable between a first position and a second position;
- a coupling assembly located at the coupling end of the scissor linkage, the coupling assembly being operatively adapted to connect the scissor linkage to a pulling mechanism; and
- a post gripping assembly located at the post end of the scissor linkage, the post gripping assembly including a first gripping jaw and a second gripping jaw, the first and second gripping jaws being movable between an open position and a closed position as the scissor linkage is moved between the first position and the second position, wherein the first and second gripping jaws are adapted to form a picket receiving opening shaped to receive a star picket when the first and second gripping jaws are located in the closed position.

Preferably the picket receiving opening is substantially Y-shaped.

Preferably the first gripping jaw is a male gripping jaw and the second gripping jaw is a female gripping jaw operatively adapted to receive the male gripping jaw.

Preferably the male gripping jaw cooperates with the female gripping jaw to define a substantially V-shaped opening.

Preferably the female gripping jaw has an elongate opening defining the upright leg of the Y-shaped picket receiving space.

Preferably the picket receiving opening is substantially T-shaped.

Preferably the male gripping jaw cooperates with the female gripping jaw to define an opening to receive the horizontal leg of the T-shaped picket.

Preferably the female gripping jaw has an elongate opening defining the upright leg of the T-shaped picket receiving space.

Preferably the post puller includes a handle assembly to be engaged by a user to move the first and second gripping jaws from the closed position to the open position.

According to a second aspect there is disclosed a post puller assembly including a post puller of the first aspect coupled to an hydraulically actuated pulling mechanism.

Preferably the hydraulically actuated pulling mechanism includes a hydraulic boom.

Preferably the hydraulic boom is an articulated arm of an earth-moving vehicle.

BRIEF DESCRIPTION OF THE DRAWINGS

Preferred embodiments of the invention will be described hereinafter, by way of examples only, with reference to the accompany drawings, wherein.

DESCRIPTION OF PREFERRED EMBODIMENTS

Figure 1:
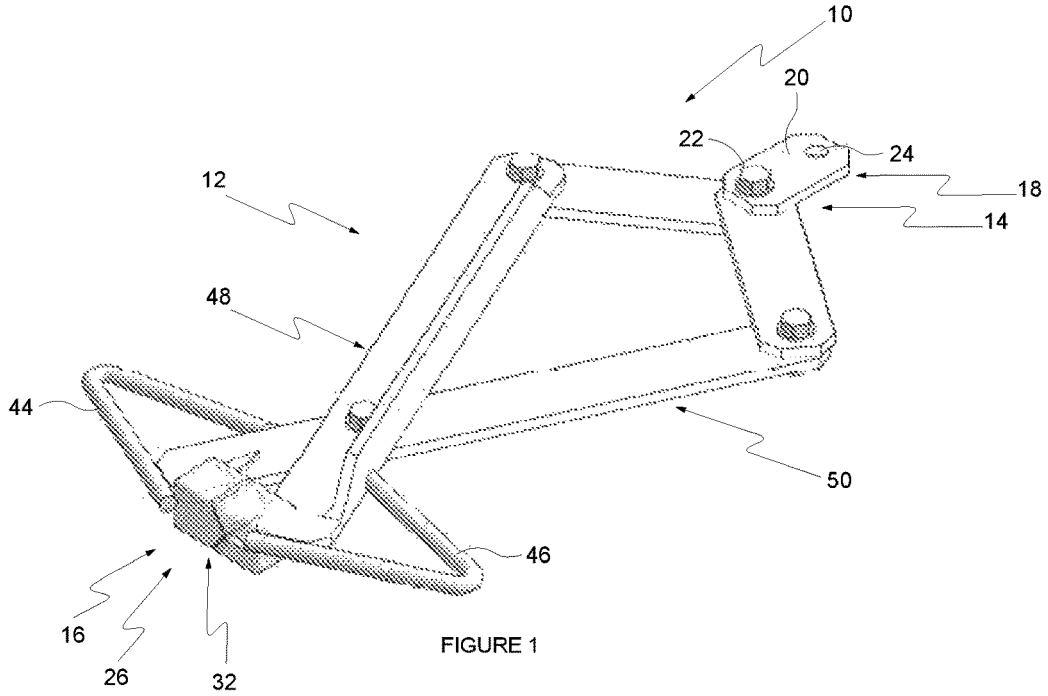
FIG. 1 is perspective view of a first embodiment post puller.
Figure 2:
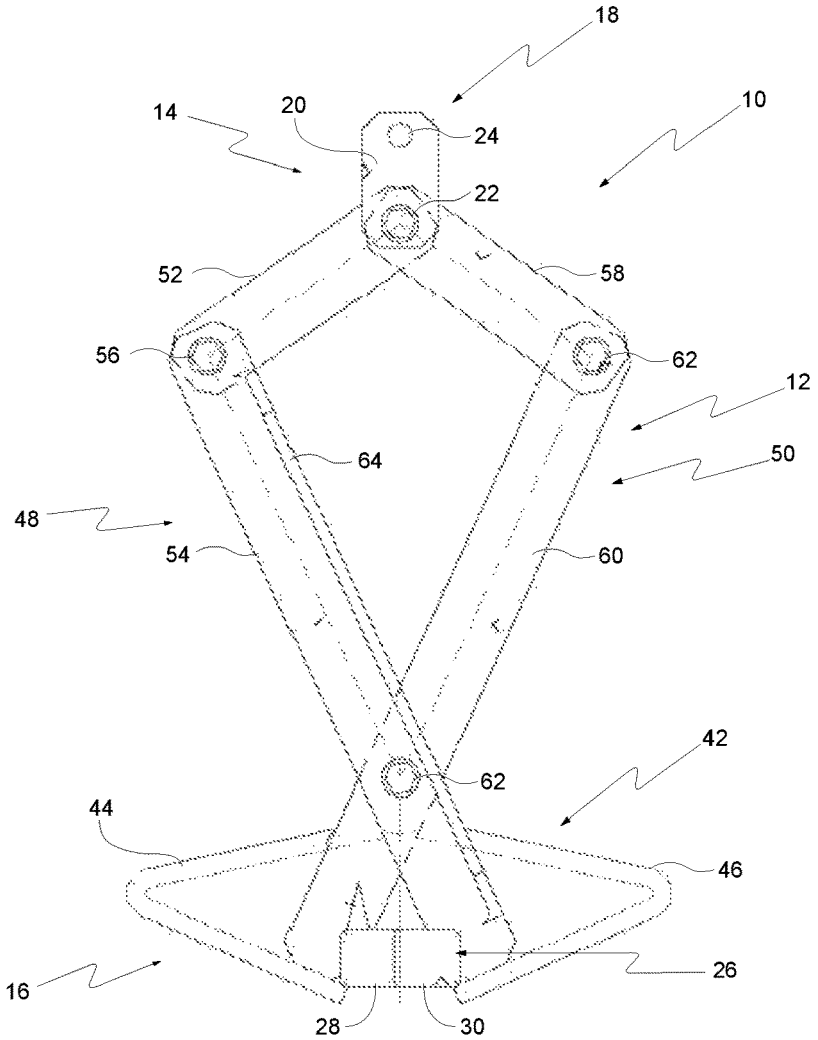
FIG. 2 is a top view of the post puller of FIG. 1.
Figure 3:
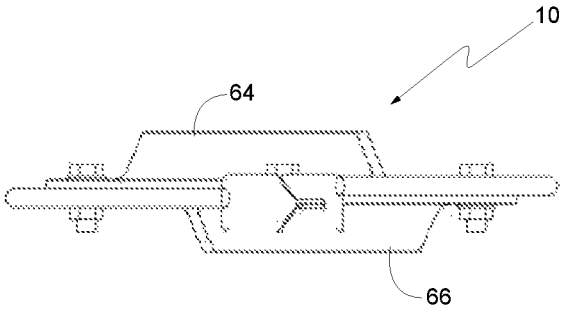
FIG. 3 is a side view of the post puller of FIG. 1.
Figure 4:
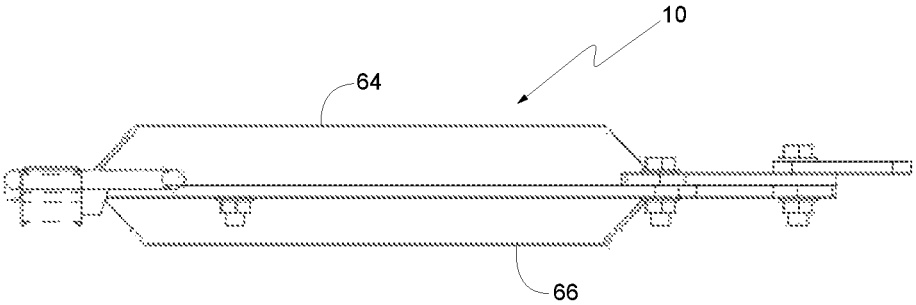
FIG. 4 is an end view of the post puller of FIG. 1.

FIGS. 1 to 4 show an embodiment post puller, generally indicated with the reference numeral 10. The post puller 10 includes a scissor linkage 12 having a coupling end 14 and a post end 16. The scissor linkage 12 is movable between a first position and second position in the conventional manner in which scissor linkages move to become elongated.

The post puller 10 further includes a coupling assembly 18 located at the coupling end 14 of the scissor linkage 12. The embodiment coupling assembly 18 includes a planar arm 20, here in the form of a flat bar, pivotally connected to the scissor linkage 12 via a joint 22, here in the form of a bolt. The planar arm 20 includes a hole 24 which is operatively adapted to connect the scissor linkage 12 to a non-illustrated shackle coupled to a non-illustrated pulling mechanism. Typically, the pulling mechanism will be provided in the form of a non-illustrated hydraulically actuated boom of an earth-moving vehicle, for example the hydraulically actuated arm of a front-end loader so as to form a non-illustrated post puller assembly.

Figure 5:
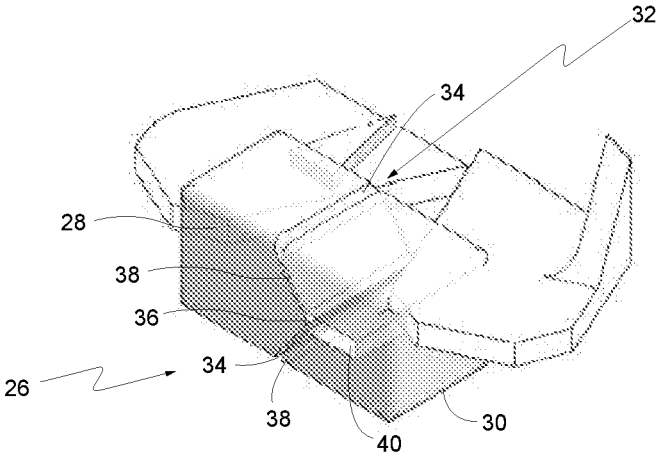
FIG. 5 is an enlarged perspective view of the post puller of FIG. 1 illustrating a first and second a gripping jaw of a post gripping assembly of the post puller.

The post puller 10 further includes a post gripping assembly 26 located at the post end 16 of the scissor linkage 12. Referring also to FIG. 5, the post gripping assembly 26 includes a first gripping jaw 28 and a second gripping jaw 30. The first and second gripping jaws 28, 30 are movable between an open position and a closed position as the scissor linkage 12 is moved between its first and second position. The first and second gripping jaws 28, 30 are adapted to form a picket receiving opening 32 shaped to receive a star picket, here a Y-shaped star picket, when the first and second gripping jaws 28, 30 are located in the closed position. In one exemplary application, the post puller 10 is coupled to a boom of a front-end loader via a chain and shackle connected to at the coupling assembly 18 of the scissor linkage 12. At the same time, a top end of a star picket is located within the picket receiving opening 32 of the post gripping assembly 26. As the front-end loader applies an upward force on the coupling assembly 18 the scissor linkage 12 will become elongated as it is moved from a first position to a second position. Such movement of the scissor linkage 12 will cause the first and second gripping jaws 28, 30 to move from an open position to a closed position. In the closed position the first and second gripping jaws 28, 30 will grip outer surfaces of the star picket. Continued movement of the scissor linkage 12 from the first position to the second position will cause the first and second gripping jaws 28, 20 to grip the star picket firmly. Further movement of the boom of the front-end loader will result in the picket being pulled from the ground.

In this embodiment the picket receiving opening 32 is substantially Y-shaped. The first gripping jaw 28 is a male gripping jaw and the second gripping jaw is a female gripping jaw 30. The female gripping jaw 30 is operatively adapted to receive the male gripping jaw 28. In particular the male gripping jaw 28 cooperates with the female gripping jaw 30 to define a substantially V-shaped opening. In this embodiment the male gripping jaw 28 has two surfaces 34 which define a pointed end 36. The female gripping jaw 30 includes two opposing female surfaces 38 which are complementally configured to the surfaces 34 and are adapted to receive the pointed end 36 therebetween.

The female gripping jaw 30 further has an elongate opening 40. The elongate opening 40 defines the upright leg of the Y-shaped picket receiving opening 32.

The post puller 10 includes a handle assembly 42 to be engaged by a user in order to move the first and second gripping jaws 28, 30 from the closed position to the open position. The hand assembly 42 includes a first and second handle 44, 46.

The scissor linkage 12 includes a first linkage arm 48 pivotally connected to a second linkage arm 50. The first linkage arm 48 includes a first upper member 52 and a first lower member 54. The first upper member 52 is pivotally connected to the first lower member 54 via a joint 56, here in the form of a bolt. The second arm linkage 50 includes a second upper member 58 and a second lower member 60. The second upper member 58 is pivotally connected to the second lower member 60 via a joint 62, also in the form of a bolt. The first and second upper members 52, 58 are pivotally connected via the joint 22. The first and second lower members 54, 60 are, in turn, pivotally coupled via a joint 62, in the form of a bolt.

Each of the first and second lower members 54, 60 includes an outwardly extending wall, respectively indicated as a first wall 64 and a second wall 66. In this embodiment the first handle 44 is connected to the second wall 66 at one end and to the male gripping jaw 28 at the other end. The second handle 46, in turn, is connected to the first handle 44 at one end and to the female gripping jaw 30 at the other end.

Figure 6:
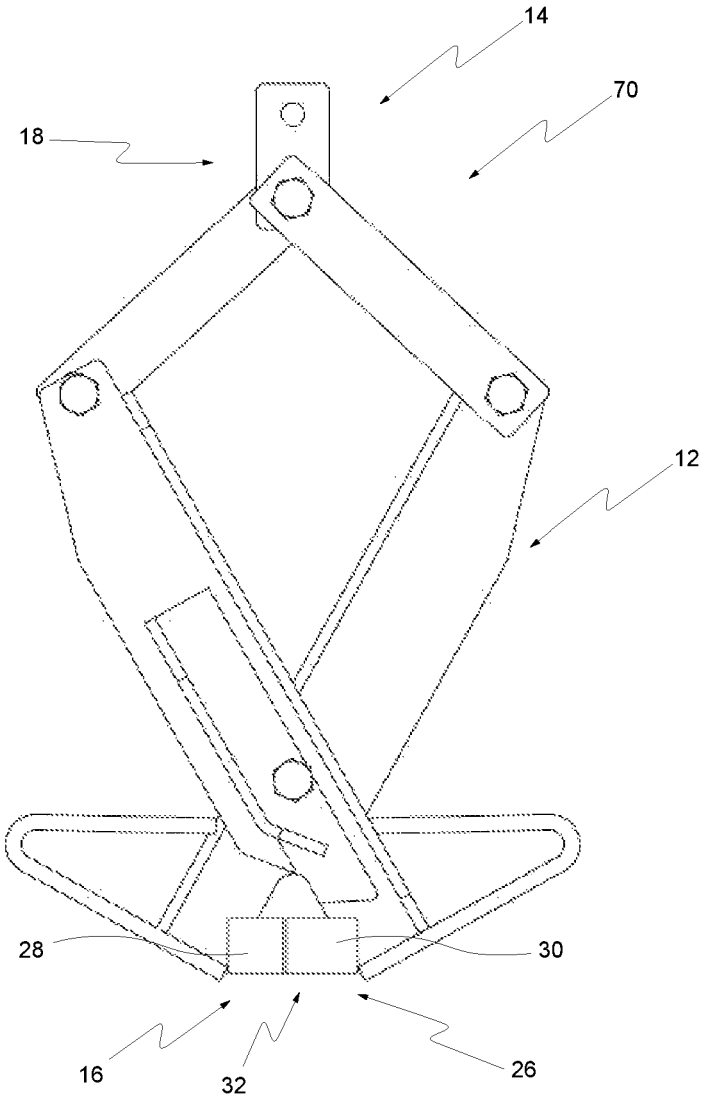
FIG. 6 is a top view of a second embodiment post puller.
Figure 7:
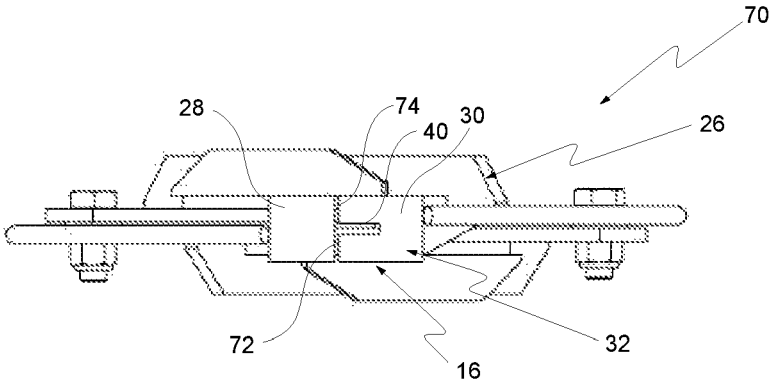
FIG. 7 is a side view of the post puller of FIG. 6.

FIGS. 6 and 7 show a second embodiment post puller, generally indicated with the reference numeral 70. Similar to the post puller 10, the post puller 70 includes a scissor linkage 12 having a coupling end 14 and a post end 16. The scissor linkage 12 is movable between a first position and second position as discussed above.

The post puller 70 also includes a coupling assembly 18, located at the coupling end 14 of the scissor linkage 12, and a post gripping assembly 26 located at the post end 16 of the scissor linkage 12. The post gripping assembly 26 of the post puller 70 includes a first gripping jaw 28 and a second gripping jaw 30. The first and second gripping jaws 28, 30 are movable between an open position and a closed position as the scissor linkage 12 is moved between its first and second position. The first and second gripping jaws 28, 30 are adapted to form a picket receiving opening 32 shaped to receive a T-shaped star picket when located in the closed position.

The picket receiving opening 32 of the post puller 70 is substantially T-shaped. The first gripping jaw 28 is a male gripping jaw and the second gripping jaw is a female gripping jaw 30. The male gripping jaw 28 cooperates with the female gripping jaw 30 to define a substantially T-shaped picket receiving opening 32. In this embodiment the male gripping jaw 28 has a substantially flat end surface 72 and the female gripping jaw 30 an opposing substantially flat end surface 74 so that the male gripping jaw 28 cooperates with the female gripping jaw 30 to define an opening to receive the horizontal leg of the T-shaped picket. The female gripping jaw 30, in turn, includes an elongate opening 40. The elongate opening 40 defines the upright leg of the T-shaped picket receiving opening 32. The second embodiment post puller 70 operates in the manner of the first embodiment post puller 10 described above.

A number of prior art hand operated post pullers exist. Those hand operated post pullers are not suited for farming and pastoral fencing operations due to the very large number of posts to be removed. The preferred embodiment post puller 10 provides a useful alternative in that it is operated with the use of a mechanical apparatus effecting the mechanical pulling operation. Also, the embodiment post puller 10 facilitates removal of a fence post in such a manner that pulled posts are suited for re-use.

Although the invention has been described with reference to a specific example, it will be appreciated by those skilled in the art that the invention may be embodied in many other forms.

KEY TO REFERENCE NUMERALS IN DRAWINGS

10 First embodiment post puller
12 Scissor linkage
14 Coupling end
16 Post end
18 Coupling assembly
20 Planar arm
22 Joint
24 Hole
26 Post gripping assembly
28 First gripping jaw
30 Second gripping jaw
32 Picket receiving opening
34 Surfaces
36 Pointed end
38 Female surfaces
40 Elongate opening
42 Handle assembly
44 Handle
46 Handle
48 First linkage arm
50 Second linage arm
52 First upper member
54 First lower member
56 Joint
58 Second upper member
60 Second lower member
62 Joint
64 First wall
66 Second wall
70 Second embodiment post puller
72 Male flat end surface 72
74 Female end surface 74

The invention claimed is:

1. A post puller including:

a scissor linkage having a coupling end and a post end, the scissor linkage being moveable between a first position and a second position;

a coupling assembly located at the coupling end of the scissor linkage, the coupling assembly being operatively adapted to connect the scissor linkage to a pulling mechanism; and a post gripping assembly located at the post end of the scissor linkage, the post gripping assembly including a first gripping jaw and a second gripping jaw, the first and second gripping jaws being movable between an open position and a closed position as the scissor linkage is moved between the first position and the second position;

wherein the first and second gripping jaws are adapted to form a picket receiving opening shaped to receive a star picket when the first and second gripping jaws are located in the closed position;

wherein the picket receiving opening is substantially T-shaped, and wherein the first gripping jaw is a male gripping jaw and the second gripping jaw is a female gripping jaw operatively adapted to co-operate with the male gripping jaw to define an opening to receive the horizontal leg of the T-shaped picket.

2. The post puller according to claim 1, wherein the female gripping jaw has an elongate opening defining the upright leg of the T-shaped picket receiving space.

3. The post puller according to claim 1, wherein the post puller includes a handle assembly to be engaged by a user to move the first and second gripping jaws from the closed position to the open position.

4. A post puller including:

a scissor linkage having a coupling end and a post end, the scissor linkage being moveable between a first position and a second position;

a coupling assembly located at the coupling end of the scissor linkage, the coupling assembly being operatively adapted to connect the scissor linkage to a pulling mechanism; and a post gripping assembly located at the post end of the scissor linkage, the post gripping assembly including a first gripping jaw and a second gripping jaw, the first and second gripping jaws being movable between an open position and a closed position as the scissor linkage is moved between the first position and the second position;

wherein the first and second gripping jaws are adapted to form a substantially Y-shaped picket receiving opening shaped to receive a star picket when the first and second gripping jaws are located in the closed position; and wherein the first gripping jaw is a male gripping jaw and the second gripping jaw is a female gripping jaw operatively adapted to receive the male gripping jaw.

5. The post puller according to claim 4, wherein the male gripping jaw cooperates with the female gripping jaw to define a substantially V-shaped opening.

6. The post puller according to claim 5, wherein the female gripping jaw has an elongate opening defining the upright leg of the Y-shaped picket receiving space.

* * * * *